US010893713B2

(12) United States Patent
Popoca Perez

(10) Patent No.: US 10,893,713 B2
(45) Date of Patent: Jan. 19, 2021

(54) MAGNETIC SYSTEM FOR FASTENING OF AN APPAREL BELT

(71) Applicant: bizandbliss, LLC, The Woodlands, TX (US)

(72) Inventor: Luis Enrique Popoca Perez, The Woodlands, TX (US)

( * ) Notice: Subject to any disclaimer, the term of this patent is extended or adjusted under 35 U.S.C. 154(b) by 59 days.

(21) Appl. No.: 16/171,209

(22) Filed: Oct. 25, 2018

(65) Prior Publication Data

US 2019/0116904 A1 Apr. 25, 2019

Related U.S. Application Data

(60) Provisional application No. 62/576,829, filed on Oct. 25, 2017.

(51) Int. Cl.
*A41F 1/00* (2006.01)
*A41F 9/02* (2006.01)
*A41F 9/00* (2006.01)

(52) U.S. Cl.
CPC ..... *A41F 1/002* (2013.01); *A41F 9/002* (2013.01); *A41F 9/025* (2013.01); *A44D 2203/00* (2013.01)

(58) Field of Classification Search
CPC ..... A41F 1/002; A41F 9/002; A41F 9/025; A44D 2203/00
See application file for complete search history.

(56) References Cited

U.S. PATENT DOCUMENTS

2004/0155738 A1* 8/2004 Kraus ..... A44C 5/14 335/205
2005/0102802 A1* 5/2005 Sitbon ..... A41F 1/002 24/303
2006/0032026 A1* 2/2006 Schoening ..... A41D 25/003 24/66.1
2009/0251255 A1* 10/2009 Fullerton ..... H01F 7/0284 335/296
2013/0326790 A1* 12/2013 Cauwels ..... A44C 5/2071 2/170
2015/0196955 A1* 7/2015 Naftalin ..... B22F 3/1055 277/629
2015/0282542 A1* 10/2015 King ..... A41D 27/22 2/271
2016/0003269 A1* 1/2016 Russell-Clarke .... A43B 1/0054 24/303
2016/0307680 A1* 10/2016 Provencher ..... H01F 7/0263
2017/0234340 A1* 8/2017 Pensak ..... A41F 1/002 24/3.1

* cited by examiner

*Primary Examiner* — Robert Sandy
*Assistant Examiner* — David M Upchurch

(57) ABSTRACT

A magnetic system for fastening of an apparel belt utilizes magnets concealed within the belt to secure the belt in the desired waist size, with said system eliminating the need for a functional buckle for fastening of the belt. The system disclosed herein further provides for novel application a non-slip coating to opposite contact ends of the belt to facilitate a secure fit of the belt and prevent loosening or unfastening of the belt once secured in the desired waist size by the wearer.

20 Claims, 8 Drawing Sheets

MAGNETIC SYSTEM FOR FASTENING OF AN APPAREL BELT

RELATED APPLICATION

This application claims the benefit of U.S. Provisional Patent Application Ser. No. 62/576,829 filed Oct. 25, 2017 and entitled "A Waist Belt Without Buckles Or Holes."

TECHNICAL FIELD OF THE INVENTION

The present invention relates to a magnetic system for the adjustment and secure fastening of an apparel belt on a wearer in a range of waist sizes without the need for a functional belt buckle or perforations in the belt material.

BACKGROUND ART OF THE INVENTION

A conventional waist belt fastening system uses a belt buckle having a belt buckle pin which interlocks with a perforation or hole in the belt material. Individuals using a conventional waist belt fastening system often experience the inconvenience and frustration of quick wear and tear on the belt caused by movement and friction of a belt buckle over the belt material and the belt buckle pin being pushed through the material during adjustment and securing of the belt. Specifically, conventional belt fastening systems require repeated pulling of the belt through the metal buckle and securing the belt by means of pushing the belt buckle pin through holes in the belt, with both the belt material and the holes in the belt being subject to stretching, wearing and tearing over the course of repeated fastening, adjusting, wearing and unfastening of the belt by the user.

Although existing systems for fastening a waist belt have previously explored the use of magnets as a securing means, existing products in that respect have a number of significant disadvantages, including the inadvertent sliding apart of opposite ends of the belt subsequent to fastening by the wearer. Existing belt fastening systems also require the use of a functional buckle which ultimately creates wear and tear on the surface of the belt, including loosening of stiches on the belt due to friction of the buckle scraping along the belt material during fastening and unfastening of the belt.

A longstanding need therefore exists for a magnetic system for fastening of an apparel belt that can securely fasten the belt without the need for a functional belt buckle and which also provides a secure fit of the belt once fastened by the wearer.

SUMMARY OF THE INVENTION

In accordance with the present invention, a magnetic system for secure fastening of an apparel belt is provided, wherein no functional belt buckle is required for fastening of the belt by the wearer. In particular, a novel system is disclosed herein for securing an apparel belt in the desired size strictly on the basis of magnetic attraction between concealed magnets evenly positioned within opposite ends of the belt, thereby making the use of a functional belt buckle, belt buckle pin and perforations in the belt entirely unnecessary for fastening purposes. The present invention further discloses the novel application of a non-slip coating to overlapping contact surfaces on each end of the belt, for purposes of prevent slipping or shifting of one end of the belt over the other end once a desired waist belt size has been selected and secured by the wearer. Use of this novel magnetic system involves simply placing one end of the belt over the other. Adjustments can be made by initial placement or by sliding the ends in opposite directions until the desired waist size is secured.

As to novel elements of the present invention, the magnetic belt fastening system of the present disclosure comprises an interior strap for retaining a series of magnets therein at each end of the belt and for providing shape and firmness to the belt. The present invention further comprises a front exterior strap and a rear exterior strap which envelop and contain the interior strap, with the front exterior strap providing a smooth aesthetically appealing outer surface of the belt in the form of a leather or textile surface and the rear exterior strap providing an inner textile lining surface of the belt which faces the wearer. Opposite polarity magnet surfaces secured within opposite ends of the interior strap therefore provide a means for adjusting and securing the belt in a variety of waist sizes as one end of the belt is placed or moved in overlapping fashion by the wearer over the opposite end of the belt.

Despite the relatively strong magnetic attraction between opposite polarity magnets positioned and concealed within the interior strap, smooth contacting and overlapping exterior surfaces of the belt may have a tendency to slide over one another subsequent to adjustment to the wearer's desired waist size, thereby resulting in the belt potentially becoming unsecured and opening into a wider diameter or waist size upon movement of the body and waist of the wearer. Accordingly, the present invention further discloses the novel application of a non-slip coating to reciprocal overlapping contact surfaces of the front exterior strap and rear exterior strap of the belt to assist with secure fastening of the belt once the belt has been adjusted by the wearer to the desired waist size. The reciprocal application of non-slip coating to the rear exterior strap and front exterior strap as disclosed herein assists in preventing sliding and unfastening of opposite ends of the belt once the belt has been adjusted to the desired size by the wearer, thereby allowing the belt to securely retain the desired waist size regardless of movement of the wearer subsequent to fastening of the belt.

The novel system disclosed herein accordingly solves a longstanding problem in the industry, not only by utilizing magnets to secure and fasten a belt in the desired waist size without any need for a buckle or perforations in the belt material, but also by disclosing a novel application of non-slip coating to the outer end-to-end contact surfaces of the belt to prevent sliding of one end of the belt over the other, thereby preventing inadvertent opening or unfastening of the belt once secured on the wearer. Additionally, the novel magnetic belt fastening system disclosed herein reduces the complexity of using a belt and thereby solves a problem long associated with the use of conventional belt buckle fastening systems by wearers having manual dexterity problems, particularly including wearers with moderate to severe arthritis affecting the hands and fingers. The invention disclosed herein eliminates such problems by providing a novel and greatly simplified apparel belt fastening system.

An alternate embodiment of the present invention discloses an optional decorative non-functional buckle for placement on the belt by the wearer. In other alternate embodiments of the present invention, the magnetic fastening system disclosed herein can be applied to bracelets, ankle bands, and necklaces. In further embodiments of the present invention, additional magnets can be included within the interior strap in order to provide additional magnetic attraction points on the belt for optional ornamental exterior metal elements desired by the wearer, including metallic buckles, metallic charms or other small metal items that will magnetically hold onto the surface of the front exterior strap of the belt via magnetic attraction with magnets concealed within the interior strap.

In yet another embodiment of the present invention, magnets secured within the interior strap allow the magnetic fastening system disclosed herein to be used as a tool belt for holding a variety of small metal objects including, without limitation, needles, nails, screws or other small metal articles or tool accessories used by wearers working in the construction industry, textile industry or other industries.

BRIEF DESCRIPTION OF THE DRAWINGS

For a more complete understanding of the present invention and for further advantages thereof, reference is now made to the following description of the preferred embodiments taken in conjunction with the accompanying drawings in which.

DETAILED DESCRIPTION OF THE INVENTION

Figure 1:
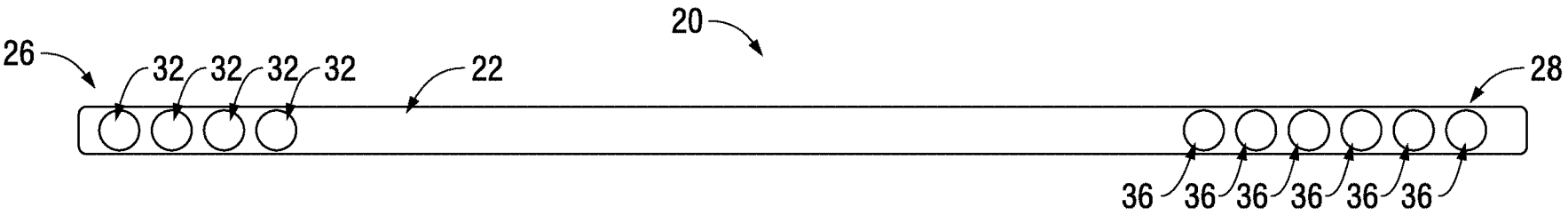
FIG. 1 is a perspective view showing the interior strap of the present invention in an open extended orientation depicting the first end and second end of said interior strap, along with depicting evenly spaced circular openings at each end of the interior strap and showing the length thereof in its entirety.

Referring to FIG. 1, system 20 of the present invention includes an interior strap 22. Interior strap 22 includes a first end 26 and a second end 28. First end 26 includes a first plurality of apertures 32. Second end 28 includes a second plurality of apertures 36. Preferably, each aperture has a diameter of about 0.709 inches (18 mm), with the center of each aperture being separated from the center of each adjacent aperture by a distance of approximately 1 inch (25.4 mm).

In a preferred embodiment of the present invention, and as shown in FIGS. 2-8, a magnetic belt fastening system 20 for securing an apparel belt around the waist of user without requiring a functional belt buckle is disclosed comprising an interior strap 22 having a first end 26 and a second end 28, a front side 27, a rear side 29, a surrounding edge 38 and a longitudinal axis extending from said first end 26 to said second end 28, a front exterior strap 40 connected to said front side 27 of said interior strap 22; a rear exterior strap 47 connected to said rear side 29 of said interior strap 22, wherein said front exterior strap 40 and said rear exterior strap 47 are secured together over said surrounding edge 38 so as to envelop said interior strap 22, with said first end 26 having a first plurality of magnets 46 secured therein and said second end 28 having a second plurality of magnets 48 secured therein, wherein said first plurality of magnets 46 and said second plurality of magnets 48 are aligned along said longitudinal axis of said interior strap 22 and the polarity of each of said first plurality of magnets 46 and said second plurality of magnets 48 is aligned. The first end 26 of said interior strap 22 can be manually curved along said longitudinal axis to overlap said second end 28 of said interior strap 22 so that said first plurality of magnets 46 can be aligned with said second plurality of magnets 48 such that at least one magnet from said first plurality of magnets 46 attracts a least one magnet from said second plurality of magnets 48 so as to form a secure connection without the need for a functional belt buckle. The front exterior strap 40 and the rear exterior strap 47 can be made of different colored material and/or material having different visual appearances or textures (including patterns). The belt of the system disclosed herein is invertible for purposes of displaying contrasting colors or surface materials of said front exterior strap and/or said rear exterior strap.

Figure 2:
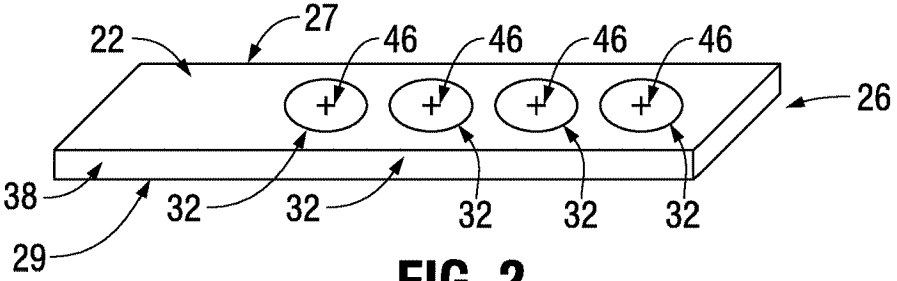
FIG. 2 is a top and side perspective view of the first end of the interior strap of the present invention showing four (4) evenly spaced circular magnets secured therein with the positive polarity pole of each magnet also being depicted.
Figure 3:
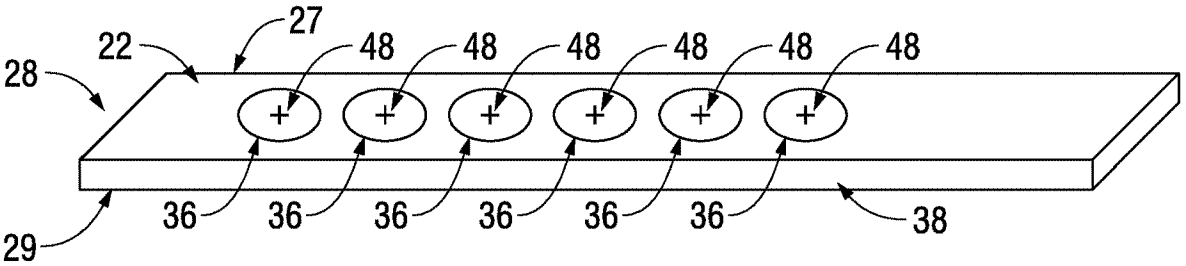
FIG. 3 is a top and side perspective view of the second end of the interior strap of the present invention showing six (6) evenly spaced magnets secured therein with the positive polarity pole of each magnet also being depicted.
Figure 4:
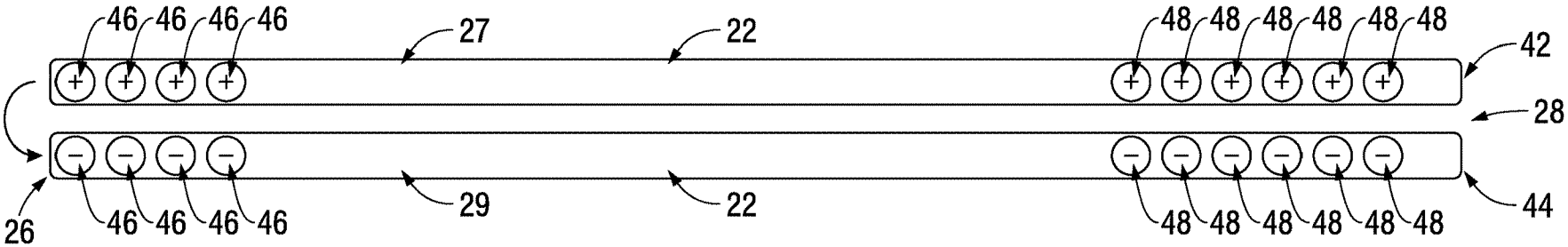
FIG. 4 is a perspective view showing both sides of the interior strap of the present invention, including a depiction of the positive and negative polarity pole of each magnet secured within said interior strap.

With reference to FIGS. 2 and 3, the respective first end 26 and second end 28 of said interior strap 22 are shown. FIG. 2 shows first end 26 of interior strap 22 having a first plurality of magnets 46 secured within said first plurality of apertures 32. FIG. 3 shows the second end 28 of interior strap 22 having a second plurality of magnets 48 secured within the second plurality of apertures 36 thereof. Each magnet in said first plurality of magnets 46 and second plurality of magnets 48 is preferably a circular magnet. FIGS. 2 and 3 additionally depict edge 38 of interior strap 22. In a preferred embodiment of the present invention, edge 38 has a thickness of approximately 0.125 inches (3.175 mm). With reference to FIG. 4, the positive polarity side 42 and negative polarity side 44 of the first plurality of magnets 46 and second plurality of magnets 48 located within interior strap 22 are shown. The polarity of all magnets is preferably oriented to be the same along the entire length of interior strap 22. In a preferred embodiment of the present invention, each magnet of first plurality of magnets 46 and second plurality of magnets 48 has a diameter of approximately 0.709 inches (18 mm) and a thickness of 0.118 inches (3 mm), with each magnet preferably being formulated from neodymium with a zinc surface and rated grade N42-N45.

Preferably, and as further depicted in FIGS. 2 and 3, the approximate 0.709 inch (18 mm) diameter of each aperture of first plurality of apertures 32 and second plurality of apertures 36 of interior strap 22 is substantially equal to the diameter of each magnet positioned therein in order to facilitate secure retention of the first plurality of magnets 46 and second plurality of magnets 48 within interior strap 22. Each magnet in the first plurality of magnets 46 and second plurality of magnets 48 is also adhesively secured within each aperture in interior strap 22 by means of an adhesive such as adhesive tape, with each magnet as depicted in FIGS. 5-8 being positioned with its positive polarity side 42 facing front exterior strap 40 and negative polarity side 44 facing rear exterior strap 47.

Figure 5:
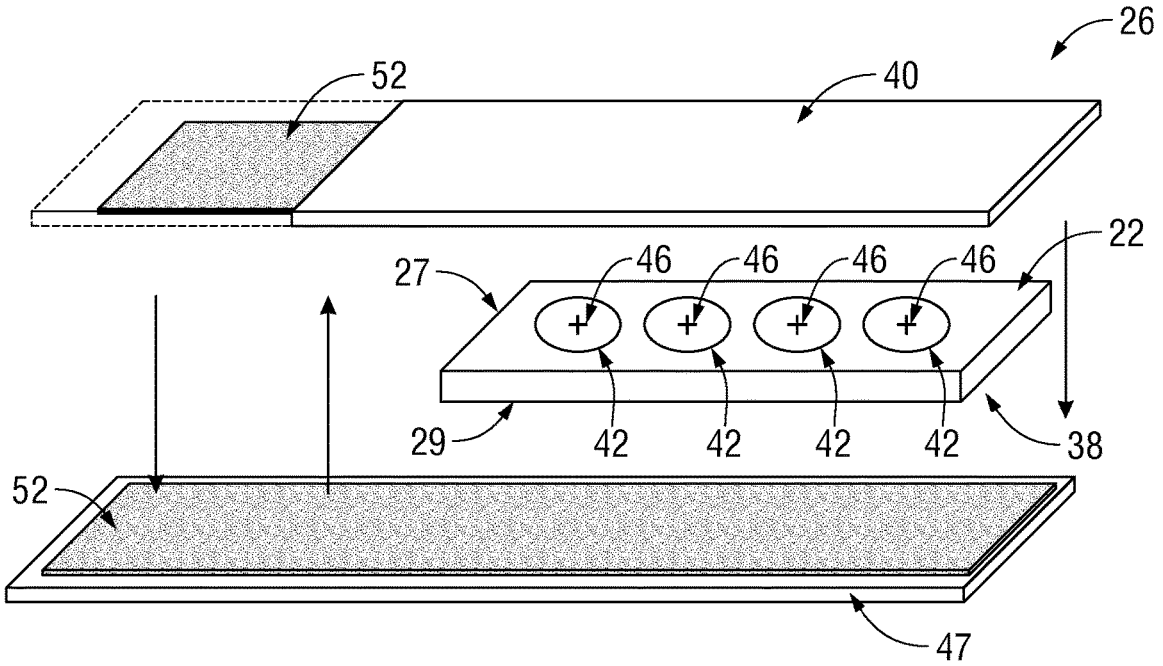
FIG. 5 is a top and side perspective view showing the front exterior strap and rear exterior strap of the first end of the present invention as positioned on either side of the interior strap, with a double-sided adhesive glue strip for securing the interior strap between the front exterior strap and rear exterior strap also being shown, and with the positive polarity pole of each magnet secured within the interior strap also being depicted.
Figure 6:
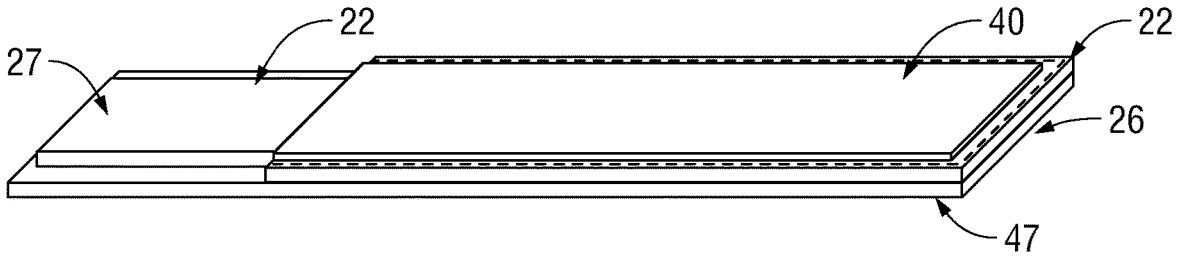
FIG. 6 is a top and side perspective view of the first end of the present invention showing the edges of the front exterior strap and rear exterior strap stitched together so as to secure the interior strap between said front exterior strap and said rear exterior strap.

FIG. 5 depicts the orientation of first end 26 of interior strap 22 between front exterior strap 40 and rear exterior strap 47 of system 20 of the present invention. The positive polarity side 42 of first plurality of magnets 46 positioned within interior strap 22 is also depicted in FIG. 5. In a preferred embodiment of the present invention, and as shown in FIGS. 5 and 6, front exterior strap 40 and rear exterior strap 47 are sized so as to fully cover and contain interior strap 22, with enough material remaining at the edges of front exterior strap 40 and rear exterior strap 47 to permit stitching together of those edges to secure interior strap 22 therein. As shown in FIG. 5, prior to stitching together of front exterior strap 40 and rear exterior strap 47, a double-sided adhesive strip 52 (e.g., glue) is applied between said front exterior strap 40 and interior strap 22, as well as between rear exterior strap 47 and interior strap 22, thereby providing a secure adhesive bond between the front exterior strap 40, interior strap 22, and rear exterior strap 47 layers of the belt of system 20.

As depicted in FIG. 6, the entire outer edge of the front exterior strap 40 and rear exterior strap 47 of the belt can be sewed together by means of conventional needle and thread stitching so as to firmly secure interior strap 22 between front exterior strap 40 and rear exterior strap 47. In a preferred embodiment of the present invention, front exterior strap 40 is formed from leather having a thickness of approximately 0.031 inches (0.787 mm). In another preferred embodiment of the present invention, rear exterior strap 47 provides a lining for the belt surface facing the wearer, has a thickness of approximately 0.040 inches (1.016 mm), and is formed from textile fabric which may include any one or more of the following materials: polypropelene, 60% cotton with 40% polyester or 100% cotton.

The interior strap 22 shown in FIGS. 1-3 and in various other illustrations set forth herein preferably has the same thickness of approximately 0.125 inches (3.175 mm) as each magnet of the first plurality of magnets 46 and second plurality of magnets 48 secured therein, such that the outer edge of each magnet sits flush within each aperture of said first plurality of apertures 32 and second plurality of apertures 36 of interior strap 22 and the surface of the overlaying front exterior strap 40 shown in FIGS. 5-8 feels smooth to the touch, thereby facilitating concealment of each magnet located within said interior strap 22 and maximizing efficiency and effectiveness of the magnetic belt fastening system 20 disclosed herein.

Figure 7:
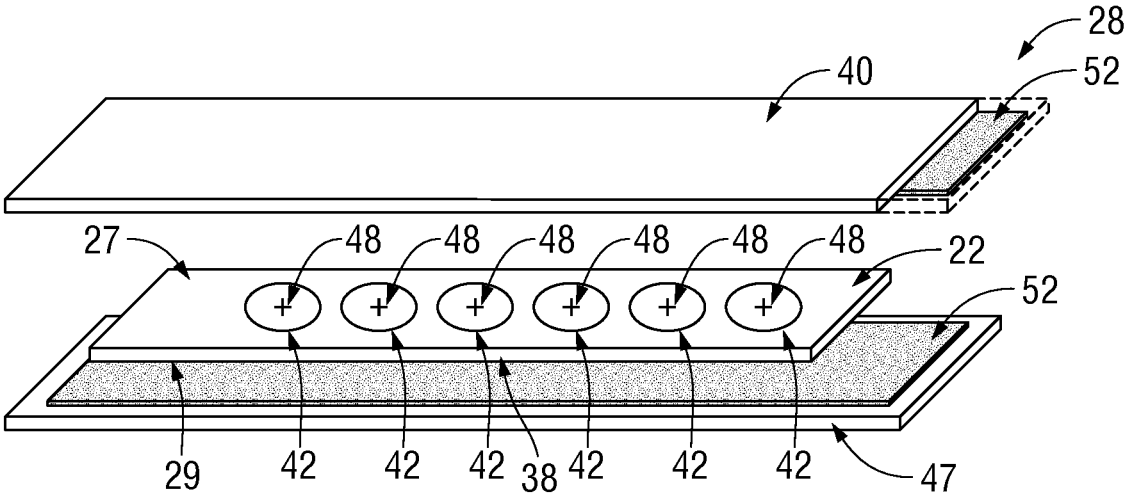
FIG. 7 is a top and side perspective view showing the front exterior strap and rear exterior strap of the second end of the present invention as positioned on either side of the interior strap, with a double-sided adhesive glue strip for securing the interior strap between the front exterior strap and rear exterior strap also being shown, and with the positive polarity pole of each magnet secured within the interior strap also being depicted.
Figure 8:
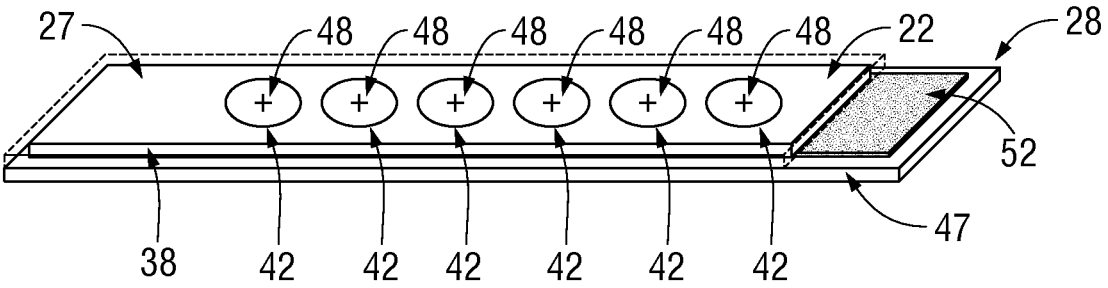
FIG. 8 is a top and side perspective view of the second end of the present invention showing the orientation of the interior strap positioned on a double-sided adhesive glue strip, with the glue strip also being adhered to the rear exterior strap, and with the rear exterior strap and adhered thereto by adhesive tape, and with the positive polarity pole of each magnet secured within the interior strap also being depicted.

Likewise, FIGS. 7 and 8 depict front exterior strap 40 and rear exterior strap 47 of the present invention, along with orientation of second end 28 of interior strap 22 between said front exterior strap 40 and rear exterior strap 47 of system 20 of the present invention. The positive polarity side 42 of the second plurality of magnets 48 positioned within interior strap 22 is also depicted in FIGS. 7 and 8. FIGS. 7 and 8 further depict double-sided adhesive glue strip 52 applied between front exterior strap 40 and interior strap 22, as well as between rear exterior strap 47 and interior strap 22, so as to provide a means for adhesively securing interior strap 22 between front exterior strap 40 and rear exterior strap 47. As further depicted in FIG. 9, the entire outer edge of front exterior strap 40 and rear exterior strap 47 of the belt of system 20 disclosed herein can be stitched together to further secure interior strap 22 between the front exterior strap 40 and the rear exterior strap 47, including at the second end 28 of interior strap 22.

As the belt is placed around a wearer's waist, the magnets can be aligned so that they face each other with opposite polarity and attract each other. Magnetic attraction between opposite polarity magnets of the first plurality of magnets 46 and second plurality of magnets 48 secured within first end 26 and second end 28 of interior strap 22 accordingly provide a means for adjusting and securing the belt of system 20 in a variety of waist sizes as one end of the belt is moved in overlapping fashion by the wearer over the opposite end of the belt. For purposes of accommodating a wide range of possible apparel belt sizes, the preferred embodiment of the present invention provides that front exterior strap 40 and rear exterior strap 47 can each alternately have a length of approximately 41.48 inches (105.39 cm), 45.48 inches (115.52 cm), 49.48 inches (125.68 cm), 53.48 inches (135.84 cm) or 57.48 inches (144.78 cm) correlating to small (sizes 30-33), medium (sizes 34-37), large (sizes 38-41), extra-large (sizes 42-45), and extra-extra-large (sizes 46-49) belt sizes, respectively.

Figure 12:
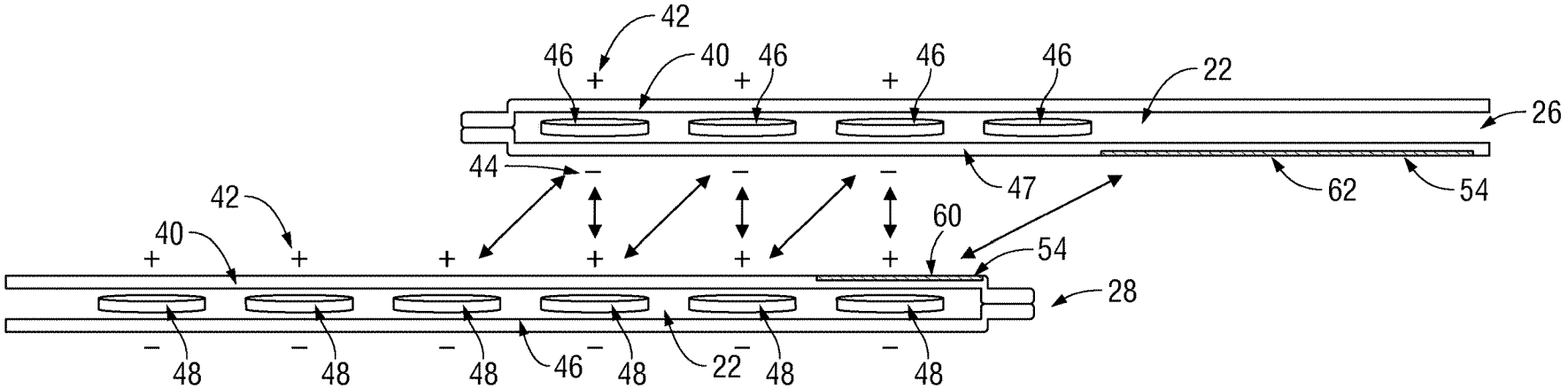
FIG. 12 is a side profile view showing each end of the belt disposed and sliding over the other and depicting reciprocal opposite polarity magnets positioned within each end of the interior strap of said belt, with application of anti-slip coating on the first end of the rear exterior strap and the second end of the front exterior strap also being depicted.
Figure 13:
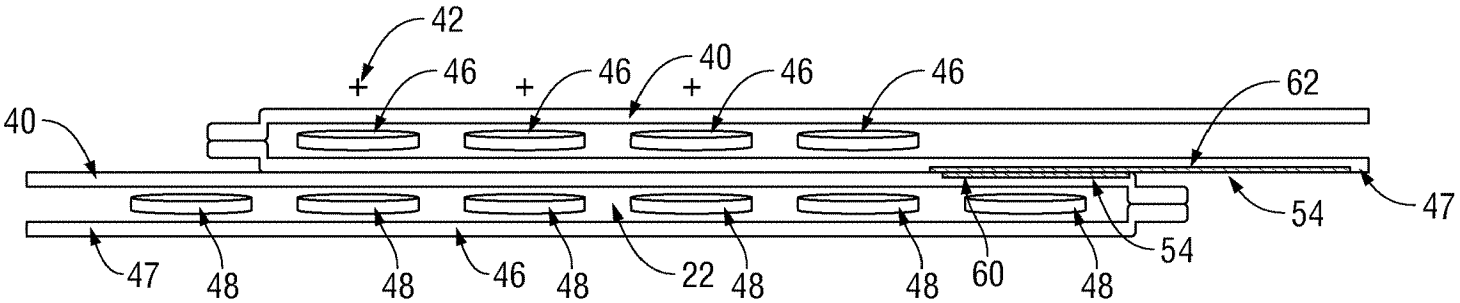
FIG. 13 is a side profile view of the present invention showing opposite ends of the belt overlapping one over the other in a fastened position secured by alignment of reciprocal opposite polarity magnets located within the interior strap of the belt.

In a another preferred embodiment of the present invention, and with reference to FIGS. 12 and 13, a method for using said magnetic fastening system for securing an apparel belt around the waist of user without requiring a functional belt buckle is disclosed comprising the steps of folding said first end 26 of said interior strap 22 of said belt over said second end 28 of said interior strap 22 such that said first end 26 is curved along said longitudinal axis of said interior strap 22 to overlap said second end 28 of said interior strap 22 wherein said first end 26 aligns at least one of said first plurality of magnets 46 over at least one of said second plurality of magnets 48 and then securing said belt in the desired waist size around user's waist by aligning a non-slip coating 54 on the rear exterior strap 47 of said belt with a non-slip coating 54 on the front exterior strap 40 of said belt so as to form a secure fit of the belt on the user without the need for a functional belt buckle. In a preferred embodiment, the method of the present invention further comprises the step of inverting the belt to display one of the materials of either said front exterior strap 40 or said rear exterior strap 47 wherein the material of said front exterior strap 40 visually contrasts with the material of said rear exterior strap 47. In a further embodiment of the present invention, non-slip coating 54 can be applied on each end of front exterior strap 40 and rear exterior strap 47 to ensure a secure fit of the belt regardless of whether said front exterior strap 40 or rear exterior strap 47 is displayed upon inverting or reversal of the belt by the user.

Figure 9:
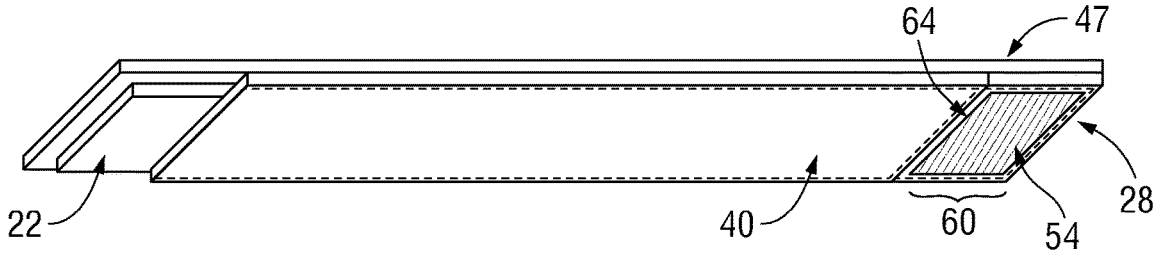
FIG. 9 is a top and side perspective view of the present invention showing the edges of the front exterior strap and rear exterior strap stitched together so as to secure the interior strap between said front exterior strap and rear exterior strap, with a non-slip coating applied to the second end of said front exterior strap also being depicted.
Figure 10:
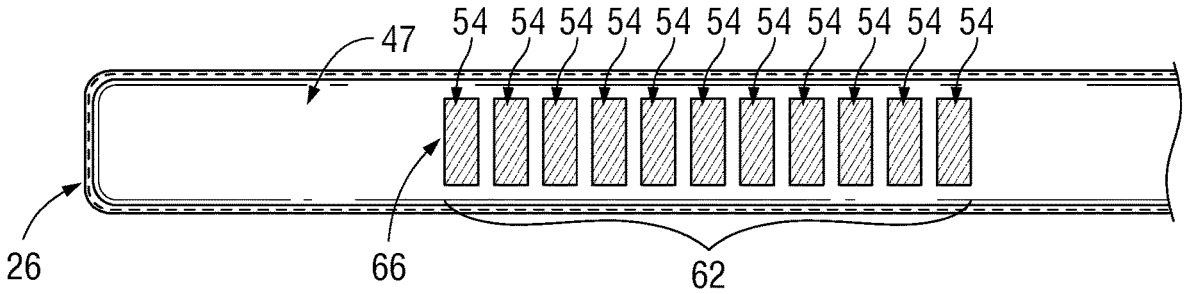
FIG. 10 is a top perspective view of the first end of the present invention showing the rear exterior strap with stitching along the edges thereof and also depicting a plurality of non-slip coatings applied to said first end of the rear exterior strap.
Figure 11:
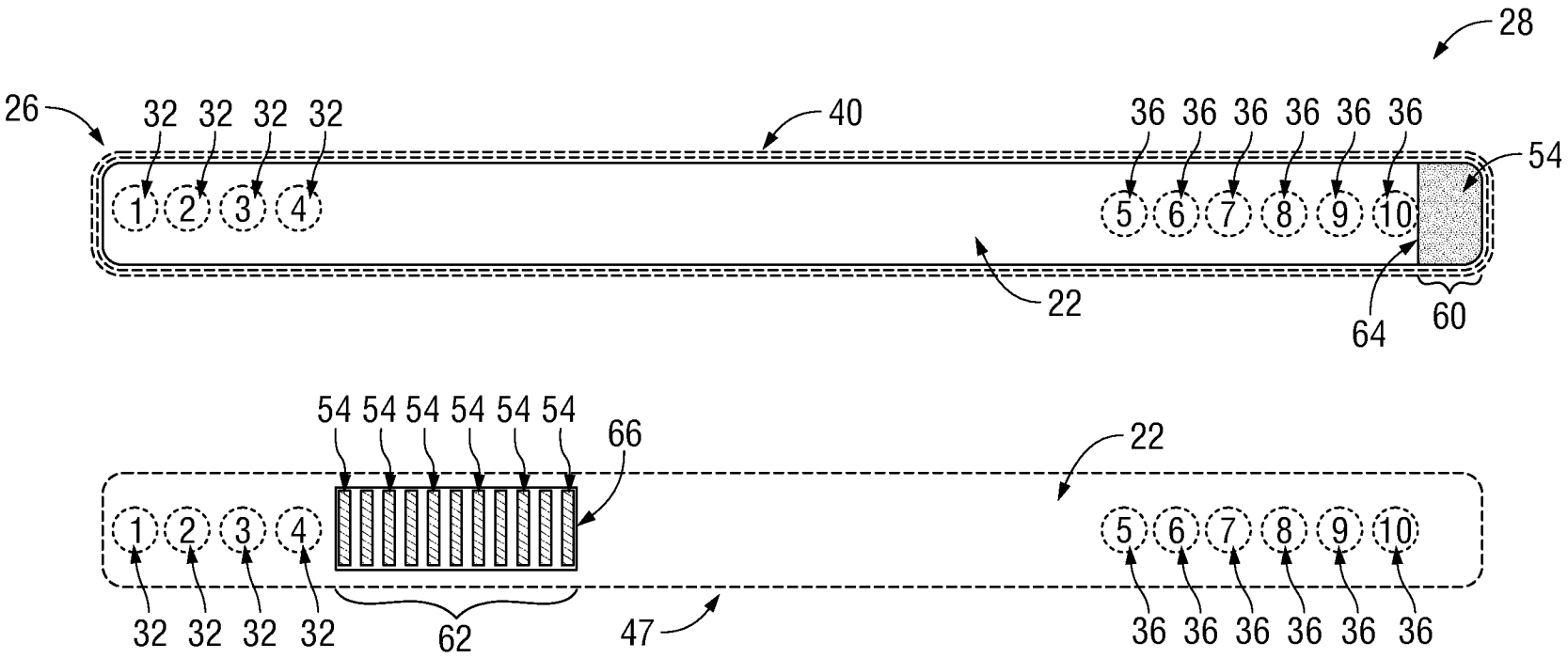
FIG. 11 is a top perspective cross-sectional view of the present invention showing the interior strap, front exterior strap, and rear exterior strap, and further depicting magnets secured within opposite ends of said interior strap, as well as a non-slip coating applied to the second end of the front exterior strap and a plurality of non-slip coatings applied to the first end of the rear exterior strap.

In a preferred embodiment of the present invention, as shown in FIGS. 9-11, the system disclosed herein further comprises a first non-slip coating 60, which can also be a plurality of coatings, on said front exterior strap 40 forming a first contact surface 64, which can also be a plurality of contact surfaces, and a second plurality of non-slip coatings 62 on said rear exterior strap 47 forming a second plurality of contact surfaces 66 for purposes of preventing unfastening of the belt once secured in the desired waist size by the wearer. The non-slip coatings are preferably rectangular, aligned in parallel, and evenly spaced along the longitudinal axis of the interior strap 22.

As shown in FIGS. 9-11, system 20 of the present invention additionally comprises the novel application of a non-slip coating 54 to the external surfaces of second end 28 of front exterior strap 40 and first end 26 of rear exterior strap 47 to prevent sliding of one end of the belt over the other once fastened around the wearer's waist, thereby ensuring a secure fit of the belt on the wearer and essentially locking the belt in place at the desired belt size. As depicted in FIGS. 9 and 11, non-slip coating 54 is preferably applied to second end 28 of the external surface of front exterior strap 40 beginning at the tip of second end 28 and running a length of approximately 1 inch (25.4 mm) with a width of approximately 1.25 inches (31.75 mm). Likewise, as depicted in FIG. 10, a counterpart application of non-slip coating 54 is applied to first end 26 of rear exterior strap 47 beginning approximately 4.25 inches (107.95 mm) from the tip of first end 26 of said rear exterior strap 47 and running a length of approximately 5.25 inches (133.35 mm) with a width of approximately 1.25 inches (31.75 mm). The length of non-slip coating 54 applied to first end 26 of rear exterior strap 47 is preferably segmented into a plurality of distinct segments. Individual segments of non-slip coating 54 are preferably each 0.25 inch (6.35 mm) in length and preferably are separated by 0.25 inches (6.35 mm) from each adjacent segment of non-slip coating 54. In the preferred embodiment of the present invention, non-slip coating 54 is a latex coating and said latex coating is applied to a textile surface on the belt approximately the same length and width as said non-slip coating 54. In an alternate embodiment of the present invention, non-slip coating 54 is a silicon-based paint. In a further embodiment of the present invention, non-slip coating 54 is a rubber-based paint.

As depicted in FIG. 12, the belt of system 20 disclosed herein is adjusted and fastened by the wearer by means of placing and/or sliding first end 26 of rear exterior strap 47 over second end 28 of front exterior strap 40, with first plurality of magnets 46 located in first end 26 of the belt sliding over and being magnetically attracted to the opposite polarity second plurality of magnets 48 located in second end 28 of the belt disclosed herein. With particular reference to FIG. 13, secure fastening of the belt is achieved when reciprocal opposite polarity first plurality of magnets 46 concealed within first end 26 and second plurality of magnets 48 located in second end 28 of the belt of system 20 align so as to magnetically bond and secure the belt in the specific waist size desired by the wearer. The desired waist size of the belt is further secured by means of overlapping contact points of non-slip coating 54 applied to first end 26 of rear exterior strap 47 and second end 28 of front exterior strap 40 as shown in FIGS. 11-13.

Figure 14:
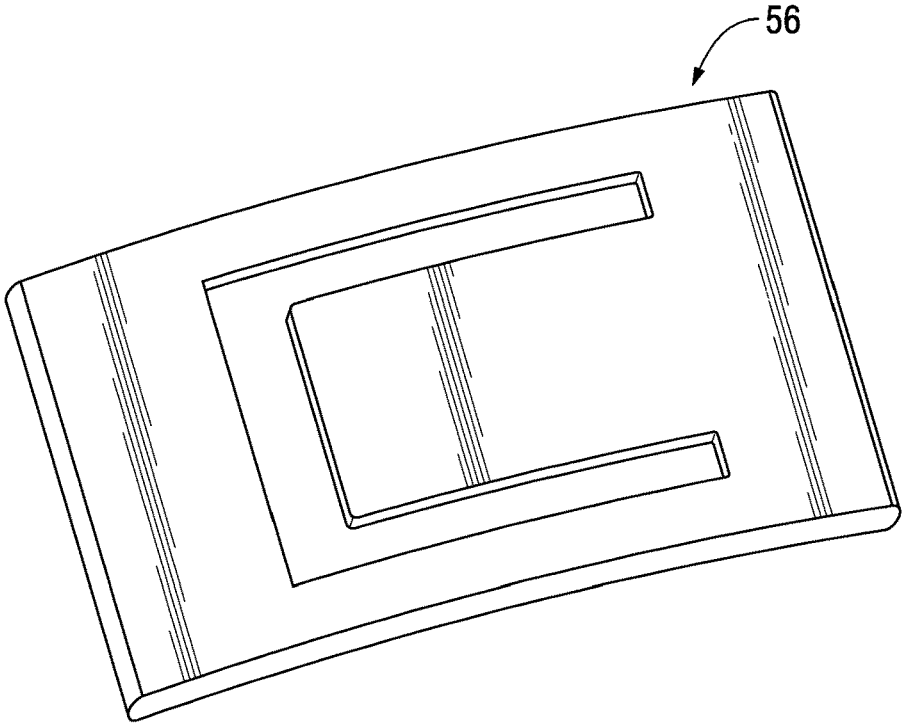
FIG. 14 is a front perspective view of the optional decorative metal buckle disclosed herein.
Figure 15:
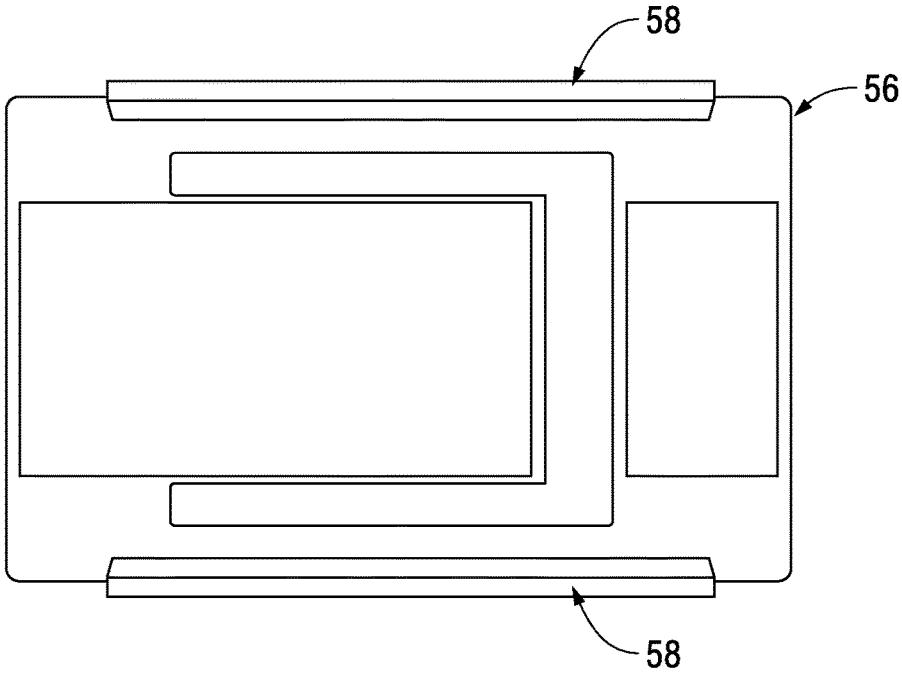
FIG. 15 is a rear perspective view of the optional decorative metal buckle disclosed herein, with a protruding rim at each long horizontal edge of the buckle for facilitating placement of the buckle on the belt also being depicted.

A decorative non-functional buckle 56 may be used as shown in FIGS. 14 and 15. Non-functional buckle 56 can serve as an aesthetic feature. Non-functional buckle 56 is preferably formed from Zamak alloy and is approximately 2.625 inches (66.68 mm)×1.5 inches (38.1 mm) in size and has a slightly protruding rim 58 preferably approximately 2 inches (50.8 mm) long and 0.5 inches (12.7 mm) wide on each long horizontal edge of said non-functional buckle 56. Each rim 58 facilitates secure placement and alignment of non-functional buckle 56 on the belt by the wearer, with non-functional buckle 56 adhering to the belt via magnetic attraction with the first plurality of magnets 46 and second plurality of magnets 48 contained within interior strap 22.

I claim:

1. A magnetic belt fastening system for securing an apparel belt around the waist of user without requiring a functional belt buckle comprising:

an interior strap having a first end and a second end, a front side, a rear side, a surrounding edge and a longitudinal axis extending from said first end to said second end;

a front exterior strap connected to said front side of said interior strap;

a rear exterior strap connected to said rear side of said interior strap, wherein said front exterior strap and said rear exterior strap are secured together over said surrounding edge so as to envelop said interior strap;

said first end having a first plurality of magnets secured therein and said second end having a second plurality of magnets secured therein, wherein said first and second plurality of magnets are aligned along said longitudinal axis and the polarity of each of said first plurality of magnets and said second plurality of magnets is aligned; and wherein said first end of said interior strap is manually curved along said longitudinal axis to overlap said second end of said interior strap so that said first plurality of magnets are aligned with said second plurality of magnets such that at least one magnet from said first plurality of magnets attracts a least one magnet from said second plurality of magnets so as to form a secure connection without the need for a functional belt buckle.

2. The system of claim 1, further comprising a non-slip coating on said second end on said front exterior strap forming a contact surface and a plurality of non-slip coatings on said first end on said rear exterior strap forming a plurality of contact surfaces for purposes of preventing unfastening of the belt once secured in the desired waist size by the wearer.

3. The system of claim 2, wherein each non-slip coating on said first end and said second end is rectangular.

4. The system of claim 1, wherein said interior strap further comprises four (4) apertures at said first end of said interior strap and six (6) apertures at said second end of said interior strap, wherein each aperture at said first end and said second end securely retains a magnet therein.

5. The system of claim 1, wherein opposite ends of the belt are pulled one over the other by the user to facilitate a secure fastening of the belt around the user's waist.

6. The system of claim 4, wherein said system allows the user to securely adjust apparel belt size by increments based upon a spacing of said magnets.

7. The system of claim 2, wherein each non-slip coating on said first and said second end comprises latex paint.

8. The system of claim 1, wherein said interior strap comprises bonded leather.

9. The system of claim 1, wherein said interior strap comprises rubber.

10. The system of claim 1, wherein said interior strap comprises foam.

11. The system of claim 1, wherein said front exterior strap comprises leather.

12. The system of claim 1, wherein said front exterior strap comprises textile fabric.

13. The system of claim 1, wherein said rear exterior strap comprises textile fabric.

14. The system of claim 1, wherein said belt is invertible for purposes of displaying contrasting colors or surface materials of said front exterior strap and said rear exterior strap.

15. The system of claim 1, wherein reciprocal edges of said front exterior strap and said rear exterior strap are stitched together over said surrounding edge of said interior strap so as to securely envelop and contain said interior strap between said front exterior strap and said rear exterior strap.

16. The system of claim 1, wherein said interior strap is secured between said front exterior strap and rear exterior strap by an adhesive glue strip applied between front exterior strap and said interior strap, as well as between the interior strap and said rear exterior strap.

17. The system of claim 1, wherein said system further comprises a decorative belt buckle having a protruding rim on each long horizontal edge thereof and being secured to said belt via magnetic attraction with at least one of said magnets.

18. A method for using the magnetic belt fastening system of claim 1 for securing an apparel belt around the waist of user without requiring a functional belt buckle comprising the steps of:

folding said first end of said interior strap of said belt over said second end of said interior strap such that said first end is curved along said longitudinal axis of said interior strap to overlap said second end of said interior strap wherein said first end aligns at least one of said first plurality of magnets over at least one of said second plurality of magnets; and securing said belt in the desired waist size around user's waist by aligning a non-slip coating on the rear exterior strap of said belt with a non-slip coating on the front exterior strap of said belt so as to form a secure fit of the belt on the user without the need for a functional belt buckle.

19. The method of claim 18, further comprising the step of inverting the belt to display one of the materials, wherein the material of said front exterior strap visually contrasts with the material of said rear exterior strap.

20. The method of claim 18, further comprising the step of attaching a decorative belt buckle via magnetic attraction between said buckle and at least one magnet.

* * * * *